US006971768B1

(12) United States Patent
Pepito et al.

(10) Patent No.: US 6,971,768 B1
(45) Date of Patent: Dec. 6, 2005

(54) DECORATIVE LIGHTING SYSTEM

(76) Inventors: Alvin M Pepito, 306 W. Country Hills Dr., La Habra, CA (US) 90631; Lota P Pepito, 306 W. Country Hills Dr., La Habra, CA (US) 90631

( * ) Notice: Subject to any disclaimer, the term of this patent is extended or adjusted under 35 U.S.C. 154(b) by 74 days.

(21) Appl. No.: 10/689,299

(22) Filed: Oct. 20, 2003

Related U.S. Application Data

(63) Continuation-in-part of application No. 10/636,334, filed on Aug. 7, 2003.

(51) Int. Cl.[7] ..... F21V 21/005
(52) U.S. Cl. ..... 362/249; 362/252; 362/311
(58) Field of Search ..... 362/145, 151, 362/152, 252, 255, 256, 311, 806–812, 249, 362/323, 391, 310, 329, 300, 253, 435–439, 362/457, 458; 40/409, 410, 439, 477

(56) References Cited

U.S. PATENT DOCUMENTS 3,204,090 A * 8/1965 Kvarda, Jr. ..... 362/249
3,302,013 A * 1/1967 Richardson ..... 362/311
3,704,365 A * 11/1972 Miller ..... 362/294
5,317,238 A 5/1994 Schaedel
5,860,731 A 1/1999 Martinez
5,918,967 A 7/1999 Land
5,957,564 A 9/1999 Bruce et al.
6,033,088 A * 3/2000 Contigiani ..... 362/249
6,224,239 B1 * 5/2001 Adler ..... 362/252
6,394,624 B1 * 5/2002 Hsu ..... 362/249
6,398,387 B1 6/2002 Wienhold
6,494,591 B1 * 12/2002 Guimond ..... 362/249
6,585,394 B2 * 7/2003 Diaco ..... 362/249

FOREIGN PATENT DOCUMENTS

CA 2309877 A1 * 12/2001 ..... A47G 33/00

* cited by examiner

*Primary Examiner*—Stephen Husar
*Assistant Examiner*—Hargobind S. Sawhney
(74) *Attorney, Agent, or Firm*—Eric Karich

(57) ABSTRACT

A lighting system has a light string, a mounting bracket, an a plurality of light covers. The light string has a main electrical cord and a plurality of light strands connected to and extending outwardly from the main electrical cord. The mounting bracket is adapted to receive a plurality of fasteners and to support the main electrical cord. The plurality of light covers are each adapted to receive one of the light strands and comprising a connecting member for connecting the light cover to the mounting bracket.

18 Claims, 6 Drawing Sheets

DECORATIVE LIGHTING SYSTEM

CROSS-REFERENCE TO RELATED APPLICATIONS

This application for a utility patent is a continuation-in-part of a previously filed utility patent, still pending, having the application Ser. No. 10/636,334, filed Aug. 7, 2003. The previous application is hereby incorporated by reference in its entirety.

STATEMENT REGARDING FEDERALLY SPONSORED RESEARCH

Not Applicable

BACKGROUND OF THE INVENTION

1. Field of the Invention

This invention relates generally to lighting systems, and more particularly to exterior lighting systems such as decorative holiday lighting.

2. Description of Related Art

Many different types of light strings are commonly used, and the use of light strings is particularly popular during holidays. Common light strings include multiple electric lamps spaced apart along an electrical cord. Icicle light strings (also called "icicle lights") are also available. A typical icicle light string has multiple light strands extending outwardly from a main electrical cord. Adjacent light strands typically have different lengths, and different numbers of electric lamps are spaced apart along adjacent light strands. When the main electrical cord is suspended along an eave of a roof, the light strands hang down from the main electrical cord and the eave.

When the electric lamps along the light strands are illuminated at night, the light strands have the appealing visual effect of icicles hanging from the eave. However, the electrical cords of the light strands are still visible, and detract from the effect. Furthermore, during the day the main electrical cord and the light strands hanging therefrom are typically clearly visible, and the icicle light string has little if any visual appeal.

It would be advantageous to have a decorative lighting system that has visual appeal both during the day and when illuminated at night.

SUMMARY OF THE INVENTION

The present invention teaches certain benefits in construction and use which give rise to the objectives described below.

The present invention provides a lighting system having a light string, a mounting bracket, an a plurality of light covers. The light string has a main electrical cord and a plurality of light strands connected to and extending outwardly from the main electrical cord. The mounting bracket is adapted to receive a plurality of fasteners and to support the main electrical cord. The plurality of light covers are each adapted to receive one of the light strands and comprising a connecting member for connecting the light cover to the mounting bracket.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
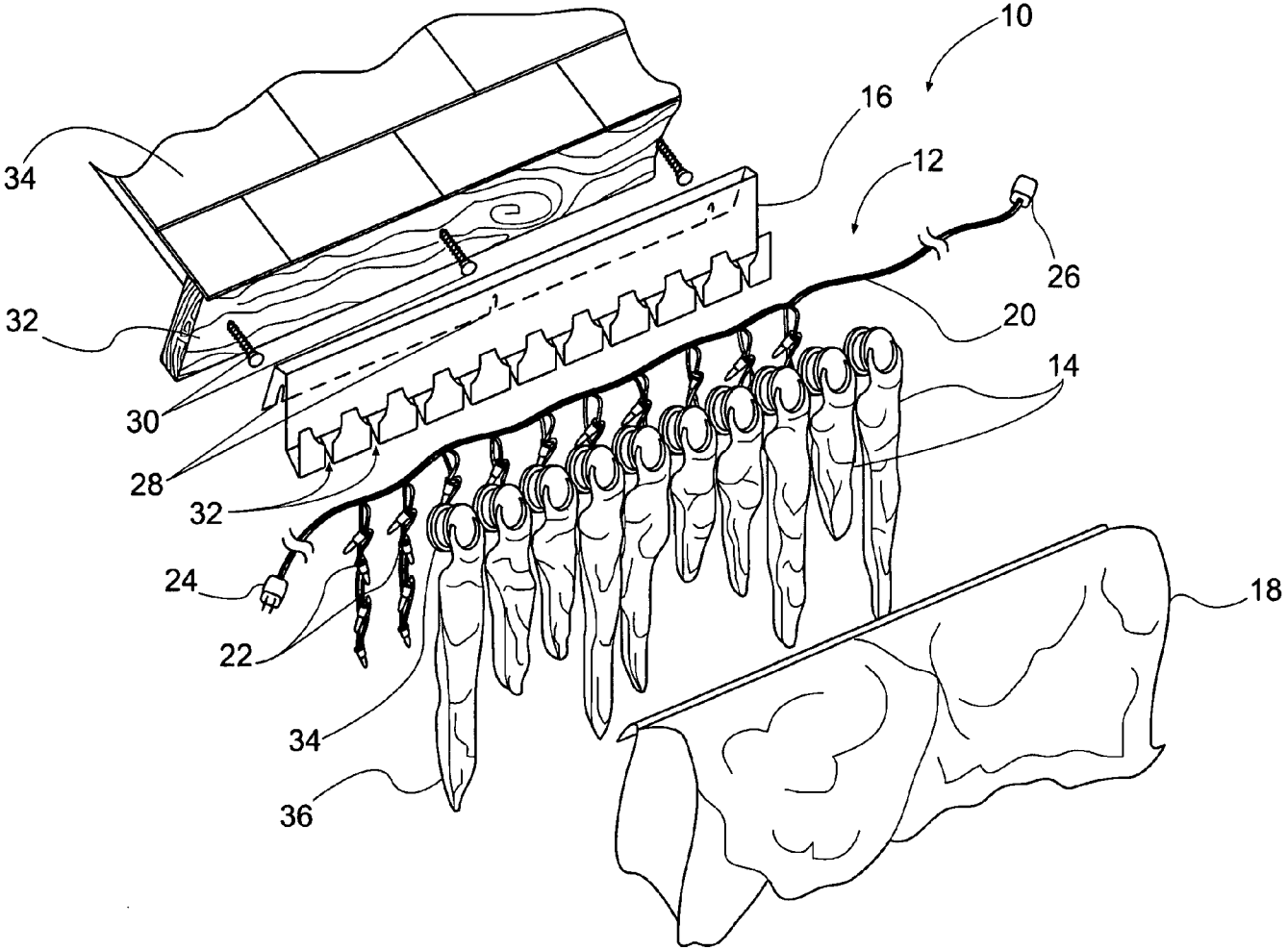
FIG. 1 is an exploded view of a lighting system including a light string, multiple decorative light covers, a mounting bracket, and a mounting bracket cover, wherein the light string includes multiple light strands extending outwardly therefrom, and wherein the mounting bracket is adapted for attachment to a fascia board of an eave of a roof of a structure via multiple fasteners.

FIG. 1 is an exploded view of a lighting system 10 including a light string 12, multiple decorative light covers 14, a mounting bracket 16, and a mounting bracket cover 18. In the embodiment of FIG. 1, the light string 12 includes a main electrical cord 20 and multiple light strands 22 connected to and extending outwardly from the main electrical cord 20. Each of the light strands 22 includes multiple electric lights receiving electrical power from the main electrical cord 20. In the embodiment of FIG. 1, one end of each of the light strands 22 is connected to the main electrical cord 20 at regular intervals along the main electrical cord 20. The main electrical cord 20 has an electrical plug 24 at one end and an electrical receptacle 26 at an opposite end.

In the embodiment of FIG. 1, the mounting bracket 16 is substantially "S" shaped in cross section and has multiple slots 28 in a rear section for receiving fasteners 30. When the fasteners 30 are inserted in a fascia board 32 of an eave of a roof 34 of a structure, and the slots 28 are slid over exposed ends of the fasteners 30, the fasteners 30 hold the mounting bracket 16 to the fascia board 32.

The mounting bracket 16 has multiple "U"-shaped cuts 32 in an upward directed edge of a front section for receiving hanging members of the decorative light covers 14. The "U"-shaped cuts 32 occur along the upward directed edge at the same regular intervals as the light strands 22 along the main electrical cord 20. As described in more detail below, the mounting bracket 16 has a trough for receiving the main electrical cord 20 of the light string 12, and slots extending from the "U"-shaped cuts 32 for receiving the individual light strands 22 of the light string 12.

While preferably made of plastic, the mounting bracket 16 may also be formed from a metal, preferably a metal that is (or is made) resistant to oxidation and corrosion.

In the embodiment of FIG. 1, each of the decorative light covers 14 includes a cylindrical hanging member 34 and a hollow body 36 extending radially from the hanging member 34. The hollow body 36 of each of the decorative light covers 14 receives a different one of the light strands 22 of the light string 12.

In the embodiment of FIG. 1, the hollow bodies 36 are shaped like icicles. In general, the cylindrical hanging members 34 and the hollow bodies 36 are translucent. The cylindrical hanging members 34 and the hollow bodies 36 preferably allow most incident light (e.g., produced by the light strands 22) to pass therethrough. The cylindrical hanging members 34 and the hollow bodies 36 are preferably made of a translucent plastic material.

Each of the cylindrical hanging members 34 has an annular groove in an exterior surface that fits into the "U"-shaped cuts 32 in the front section of the mounting bracket 16. When a cylindrical hanging member 34 of a decorative light cover 14 is inserted into one of the "U"-shaped cuts 32 of the mounting bracket 16, the force of gravity acting on the corresponding body 36 causes the cylindrical hanging member 34 to rotate within the "U"-shaped cut 32 until the body 36 is substantially directly below the cylindrical hanging member 34. As a result, any angle of the fascia board 32 relative to a horizontal plane (e.g., a foundation of the structure) is accommodated in a visually appealing way automatically (i.e., without any further action by an installer).

In the embodiment of FIG. 1, the mounting bracket cover 18 attaches to the mounting bracket 16, and substantially covers the mounting bracket 16 when attached thereto. In the embodiment of FIG. 1, the mounting bracket cover 18 is shaped and prepared to resemble a block of ice. The mounting bracket cover 18 is preferably made of plastic. Like the decorative light covers 14, the mounting bracket cover 18 may be translucent (e.g., made of a translucent plastic material). When translucent, the mounting bracket cover 18 preferably allows most incident light (e.g., produced by the light strands 22) to pass therethrough. The mounting bracket cover 18 may also be substantially opaque.

Figure 2:
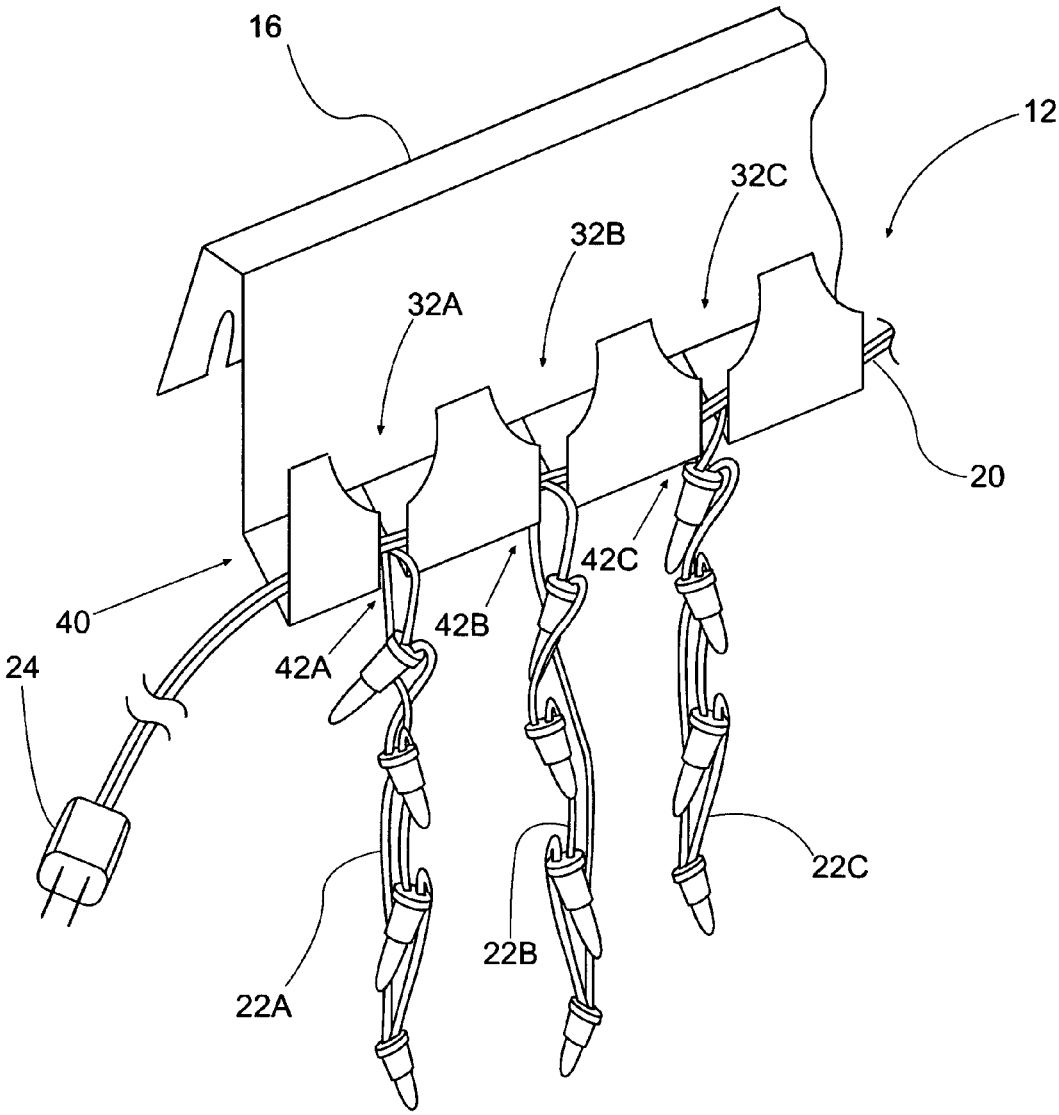
FIG. 2 is a perspective view of a portion of the lighting system of FIG. 1 wherein the light string is positioned in the front section of the mounting bracket.

FIG. 2 is a perspective view of a portion of the lighting system 10 of FIG. 1 wherein the light string 12 is positioned in the front section of the mounting bracket 16. In FIG. 2 the main electrical cord 20 of the light string 12 is positioned in a trough 40. A light strand 22A of the light string 12 is positioned in a slot 42A extending from a "U"-shaped cut 32A in the upward directed edge of the front section of the mounting bracket 16. Similarly, a light strand 22B is positioned in a slot 42B extending from a "U"-shaped cut 32B, and a light strand 22C is positioned in a slot 42C extending from a "U"-shaped cut 32C.

Figure 3:
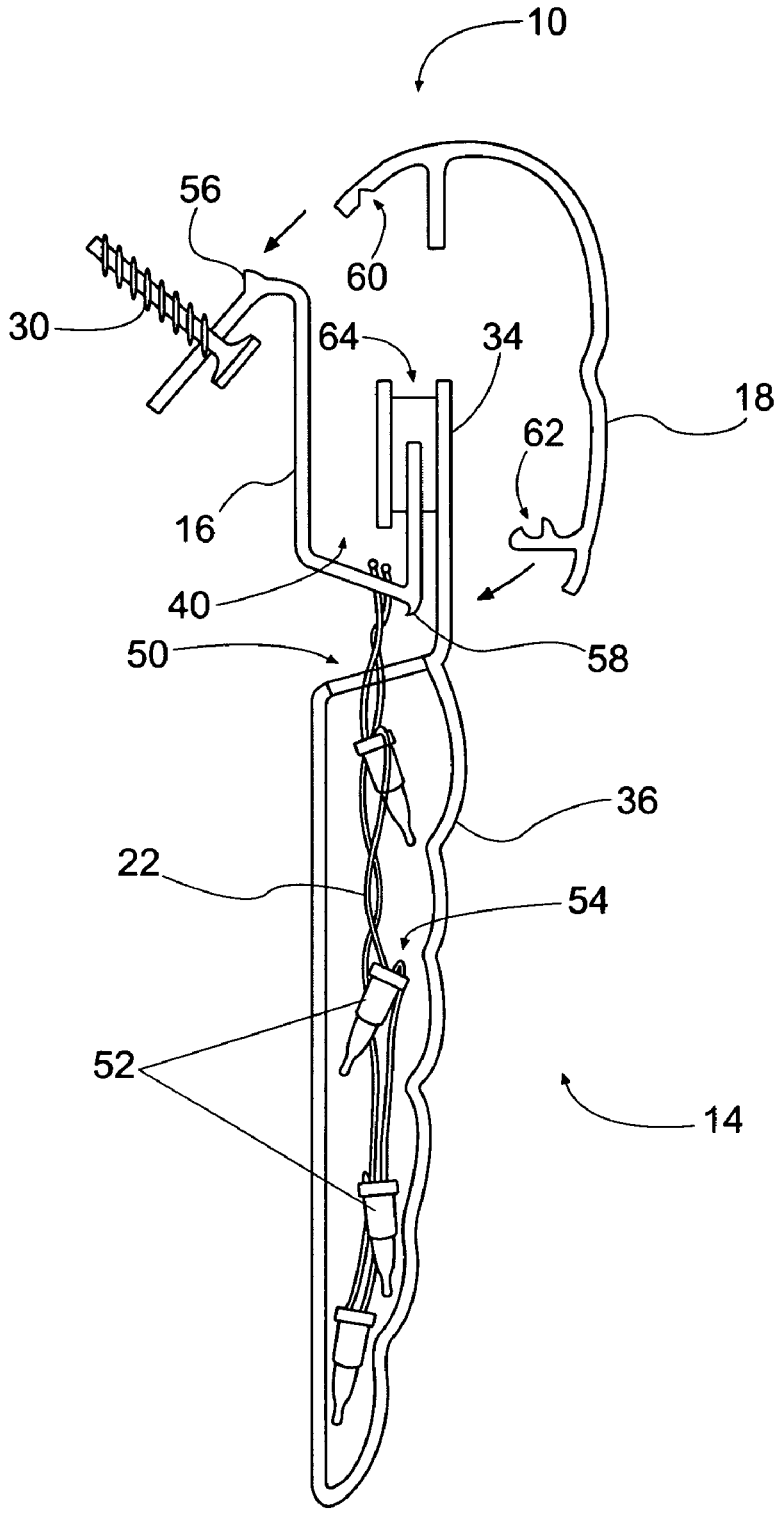
FIG. 3 is a cross-sectional view of the lighting system of FIG. 1 wherein one of the light strands of the light string is positioned in a hollow body of one of the decorative light covers, and illustrating how the mounting bracket cover is attached to the mounting bracket.

FIG. 3 is a cross-sectional view of the lighting system 10 of FIG. 1 wherein one of the light strands 22 of the light string 12 is positioned in the hollow body 36 of one of the decorative light covers 14, and illustrating how the mounting bracket cover 18 is attached to the mounting bracket 16.

In the embodiment of FIG. 3, the hollow body 36 of the decorative light cover 14 has a hole 50 in a portion adjacent to the corresponding hanging member 34 for receiving the light strand 22. In the embodiment of FIG. 3, the hollow body 36 is substantially tubular, and the hole 50 exists in one of 2 opposite ends connected to the corresponding hanging member 34. The light strand 22 hangs loosely within a cavity 54 of the hollow body 36, and includes 4 incandescent lamps 52 electrically connected in series.

In the embodiment of FIG. 3, the mounting bracket 16 has a rib 56 extending from an upper surface of the rear section and a rib 58 extending from an underside surface the front section. The curved mounting bracket cover 18 has a groove 60 along an upper inside edge and a groove 62 along a lower inside edge. When the groove 60 receives the rib 56 of the mounting bracket 16, and the groove 62 receives the rib 58, the mounting bracket cover 18 is attached to the mounting bracket 16.

Evident in FIG. 3 is the annular groove 64 in the exterior surface of the cylindrical hanging member 34. As described above, the annular groove 64 that fits into the "U"-shaped cuts 32 of FIGS. 1 and 2 in the front section of the mounting bracket 16.

Figure 4:
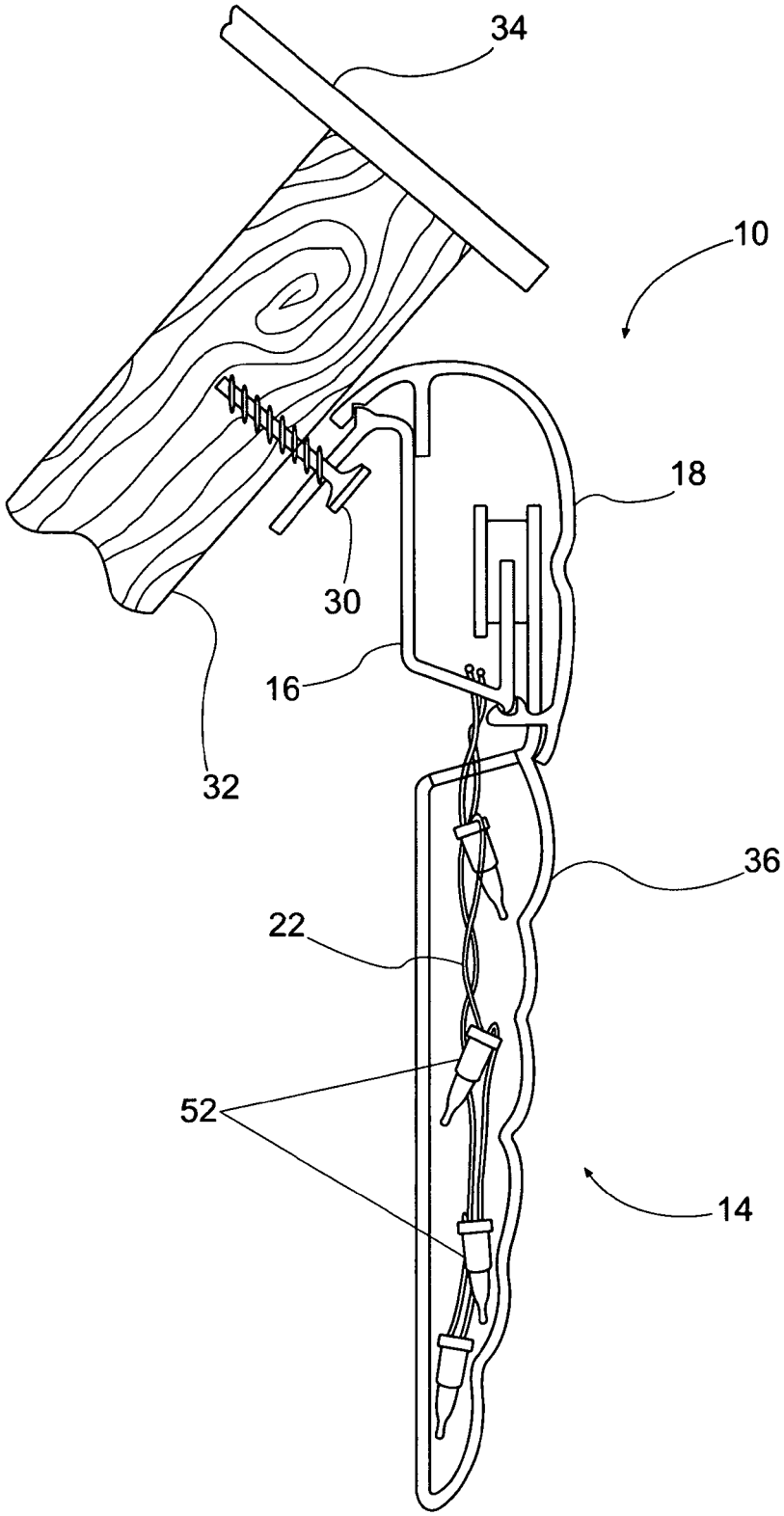
FIG. 4 is a cross-sectional view of the lighting system of FIG. 3 wherein the mounting bracket cover is attached to the mounting bracket, and wherein the mounting bracket is attached to the fascia board of the eave of the roof of the structure via the fasteners.

FIG. 4 is a cross-sectional view of the lighting system 10 of FIG. 3 wherein the mounting bracket cover 18 is attached to the mounting bracket 16, and wherein the mounting bracket 16 is attached to the fascia board 32 of the eave of the roof 34 of the structure via the fasteners 30.

Figure 5:
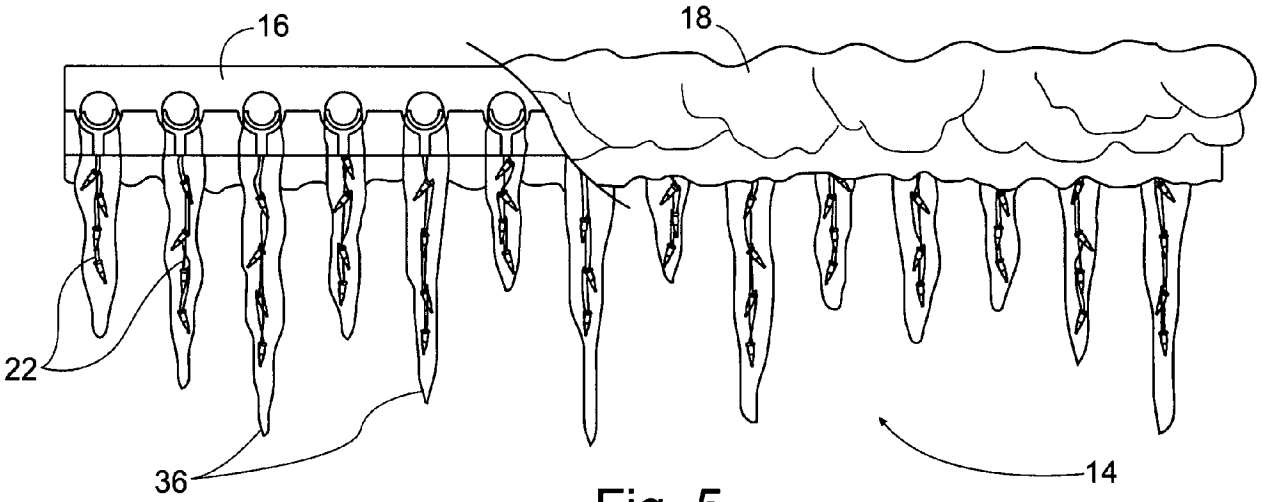
FIG. 5 is a side elevation view of the lighting system of FIG. 1 in assembly wherein the light strands of the light string are positioned in hollow bodies of the decorative light covers, cylindrical hanging members of the decorative light covers are positioned in "U"-shaped cuts of the mounting bracket, and the mounting bracket cover is attached to the mounting bracket.

FIG. 5 is a side elevation view of the lighting system 10 of FIG. 1 in assembly wherein the light strands 22 of the light string 12 are positioned in the hollow bodies 36 of the decorative light covers 14, the cylindrical hanging members 34 of the decorative light covers 14 are positioned in the "U"-shaped cuts 32 of the mounting bracket 16, and the mounting bracket cover 18 is attached to the mounting bracket 16. In FIG. 5, the mounting bracket 16 is horizontally oriented such that the bodies 36 of the decorative light covers 14 hang straight down from the mounting bracket 16, and are substantially perpendicular to the mounting bracket 16.

Figure 6:
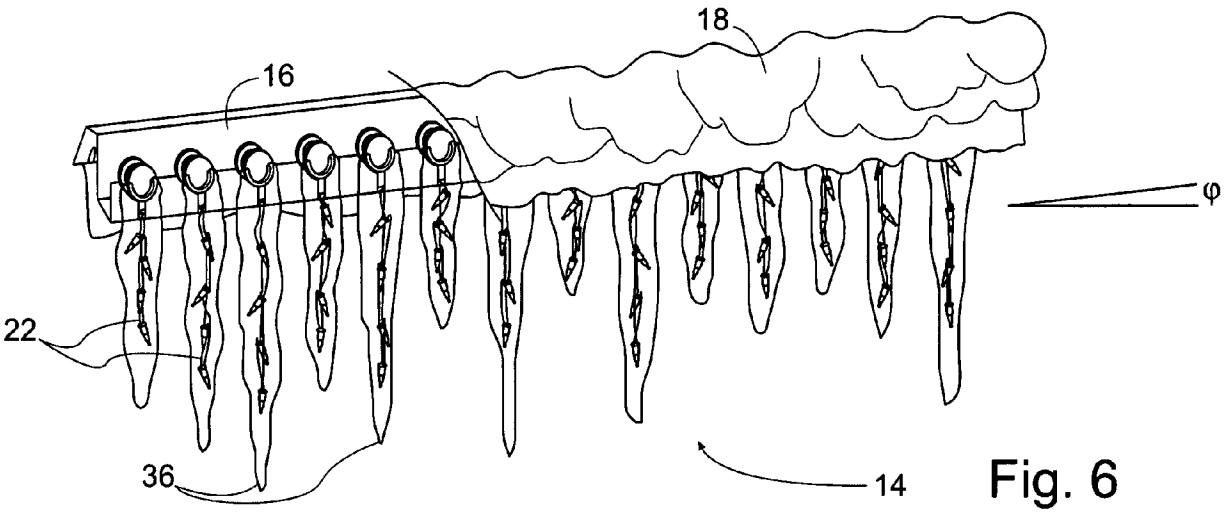
FIG. 6 is a side elevation view of the lighting system of FIG. 5 wherein the mounting bracket is mounted at an angle $\phi$ to a horizontal plane, wherein $\phi>0$.

FIG. 6 is a side elevation view of the lighting system 10 of FIG. 5 wherein the mounting bracket 16 is mounted at an angle $\phi$ to a horizontal plane, wherein $\phi>0$. This occurs, for example, along portions of structures with gable roofs where the fascia board 32 of the eave of the roof 34 is angled. As described above, the force of gravity acting on the bodies 36 causes the cylindrical hanging members 34 of the decorative light covers 14 to rotate within the corresponding "U"-shaped cuts 32 until the bodies 36 are substantially directly below the cylindrical hanging member 34. As a result, the decorative light covers 14 hang straight down from the mounting bracket 16 in a visually appealing manner, and without any further action by the installer.

Figure 7:
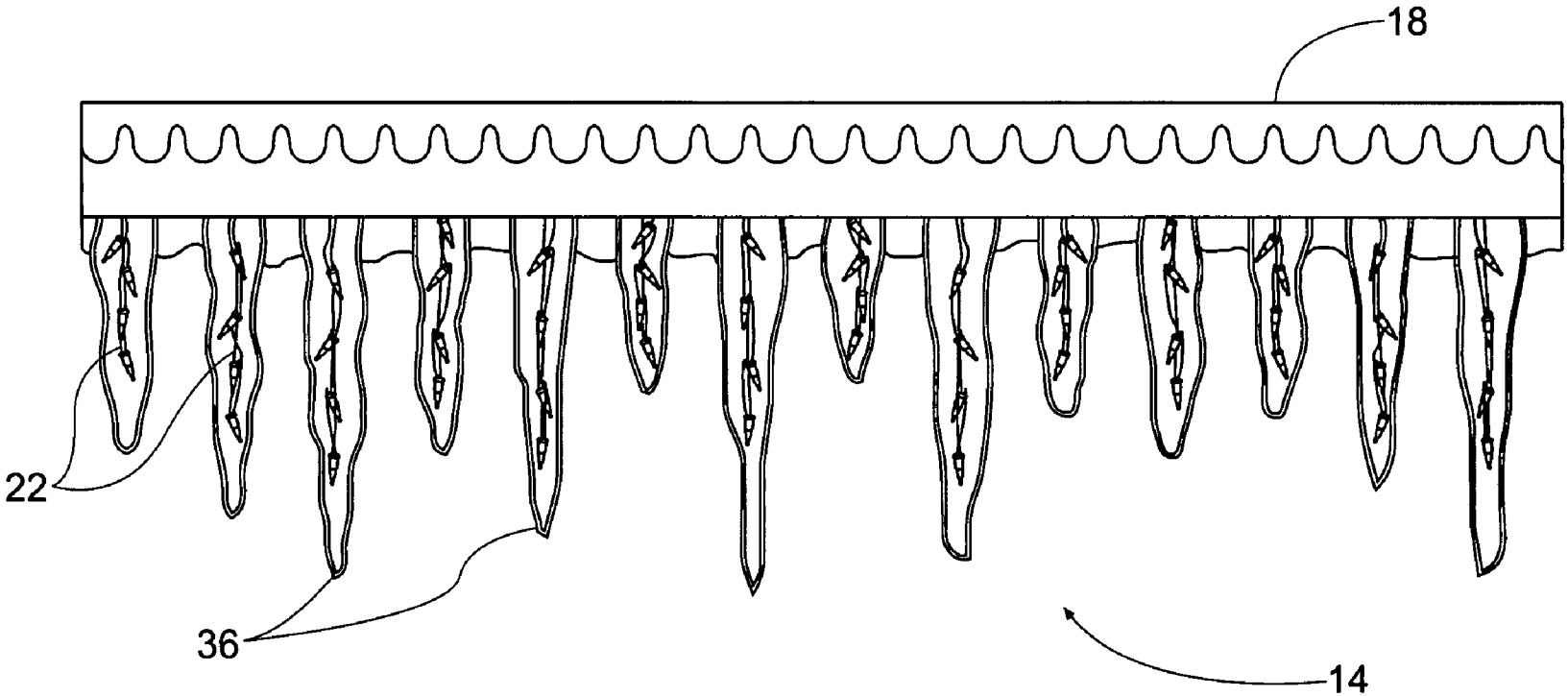
FIG. 7 is a side elevation view of the lighting system of FIG. 1 in assembly, wherein a front surface of the mounting bracket cover has a visually appealing pattern formed thereon.

FIG. 7 is a side elevation view of the lighting system 10 of FIG. 1 in assembly, wherein a front surface of the mounting bracket cover 18 has a visually appealing pattern formed thereon.

Referring to FIGS. 1–7, it is noted that the decorative light covers 14 cover the light strands 22, and the decorative mounting bracket cover 18 substantially covers the mounting bracket 16 when attached thereto. Accordingly, it is believed that the lighting system 10 of FIGS. 1–7 has visual appeal both during the day and when illuminated at night.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A lighting system, comprising:

a light string comprising a main electrical cord and a plurality of light strands connected to and extending outwardly from the main electrical cord;

a mounting bracket adapted to receive a plurality of fasteners and to support the main electrical cord;

a plurality of light covers each adapted to receive one of the light strands and comprising a connecting member for connecting the light cover to the mounting bracket; and wherein the mounting bracket comprises a plurality of "U"-shaped cuts in an upward directed edge for receiving the connecting member of the light covers.

2. The lighting system as recited in claim 1, wherein the connecting member comprises a cylindrical hanging member having an annular groove in an exterior surface.

3. The lighting system as recited in claim 1, wherein each of the light covers comprises: a hollow body adapted to receive one of the light strands of the light string; and a cylindrical hanging member adapted for insertion into one of the "U"-shaped cuts of the mounting bracket.

4. The lighting system as recited in claim 3, wherein the hollow body extends radially from the cylindrical hanging member.

5. The lighting system as recited in claim 4, wherein when the cylindrical hanging member of a given one of the light covers is inserted into one of the "U"-shaped cuts of the mounting bracket, the force of gravity acting on the body of the given light cover causes the cylindrical hanging member to rotate within the "U"-shaped cut until the body is substantially directly below the cylindrical hanging member.

6. The lighting system as recited in claim 1, wherein each of the light strands comprises a plurality of electric lights.

7. The lighting system as recited in claim 6, wherein the electric lights are adapted to receive electrical power from the main electrical cord.

8. The lighting system as recited in claim 1, wherein the light covers are translucent.

9. The lighting system as recited in claim 1, wherein each of the light strands comprises two opposed ends, and wherein one end of each of the light strands is connected to the main electrical cord.

10. The lighting system as recited in claim 1, wherein the light strands are connected to the main electrical cord at regular intervals along the main electrical cord.

11. The lighting system as recited in claim 1, wherein the main electrical cord comprises an electrical plug at one end and an electrical receptacle at an opposite end.

12. The lighting system as recited in claim 1, wherein the mounting bracket is substantially "S" shaped in cross section and comprises a front section and a rear section.

13. The lighting system as recited in claim 12, wherein the rear section of the mounting bracket comprises a plurality of slots for receiving the fasteners.

14. The lighting system as recited in claim 12, wherein the front section of the mounting bracket comprises a trough for supporting the main electrical cord of the light string.

15. The lighting system as recited in claim 12, wherein the front section of the mounting bracket comprises a plurality of "U"-shaped cuts in an upward directed edge for receiving the connecting members of the light covers.

16. The lighting system as recited in claim 15, wherein the front section of the mounting bracket comprises a plurality of slots extending from the "U"-shaped cuts for receiving the light strands of the light string.

17. The lighting system as recited in claim 1, further comprising a mounting bracket cover adapted for attaching to the mounting bracket, the mounting bracket cover being adapted to substantially cover the mounting bracket when attached thereto.

18. A lighting system, comprising:

a light string comprising a main electrical cord and a plurality of light strands connected to and extending outwardly from the main electrical cord;

a mounting bracket adapted to receive a plurality of fasteners and to support the main electrical cord, and having a plurality of "U"-shaped cuts in an upward directed edge;

a plurality of light covers, each comprising:

a hollow body adapted to receive one of the light strands of the light string; and a cylindrical hanging member adapted for insertion into one of the "U"-shaped cuts of the mounting bracket.

* * * * *